United States Patent [19]

Rosenthal et al.

[11] 4,354,920

[45] Oct. 19, 1982

[54] COAL LIQUEFACTION PROCESS

[75] Inventors: Joel W. Rosenthal, El Cerrito; Arthur J. Dahlberg, Rodeo, both of Calif.

[73] Assignee: Chevron Research Company, San Francisco, Calif.

[21] Appl. No.: 241,898

[22] Filed: Mar. 9, 1981

Related U.S. Application Data

[63] Continuation-in-part of Ser. No. 754,198, Dec. 27, 1976, Pat. No. 4,330,389.

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 1,988,019 | 1/1935 | Pier | 208/8 |
| 3,143,489 | 8/1964 | Gorin | 208/8 |
| 3,232,861 | 2/1966 | Gorin et al. | 208/8 |
| 3,705,092 | 12/1972 | Gatsis | 208/8 LE |
| 3,840,456 | 10/1974 | Yavorsky et al. | 208/10 |
| 3,884,796 | 5/1975 | Hinderliter et al. | 208/10 X |
| 3,925,188 | 12/1975 | Lester | 208/8 LE |
| 3,957,619 | 5/1976 | Chun et al. | 208/10 |
| 3,966,584 | 6/1976 | Gray et al. | 208/131 X |
| 3,997,426 | 12/1976 | Montagna et al. | 208/10 |
| 4,018,663 | 4/1977 | Karr | 208/10 |
| 4,028,221 | 6/1977 | Sze | 208/8 |
| 4,032,428 | 6/1977 | Johnson | 208/10 X |
| 4,052,291 | 10/1977 | Espenscheid | 208/8 LE |
| 4,054,504 | 10/1977 | Chervenok | 208/10 |
| 4,057,484 | 11/1977 | Malek | 208/8 LE |
| 4,110,192 | 8/1978 | Hildebrand et al. | 208/10 |
| 4,111,786 | 9/1978 | Sugimura et al. | 208/8 LE |
| 4,111,788 | 9/1978 | Chervenak et al. | 208/10 |
| 4,214,977 | 7/1980 | Ravganathen et al. | 208/10 X |

*Primary Examiner*—Delbert E. Gantz
*Assistant Examiner*—William G. Wright
*Attorney, Agent, or Firm*—D. A. Newell; S. R. La Paglia; A. H. Uzzell

[57] ABSTRACT

Disclosed is a two-stage process for the production of liquid hydrocarbons from coal. More particularly, disclosed is a two-stage coal liquefaction process wherein subdivided coal is substantially dissolved in a solvent in a first non-catalytic dissolving stage at the temperature in the range 750° to 900° F. In a second stage, the mixture of solvent, dissolved coal and insoluble solids is contacted with a hydrocracking catalyst at a critical temperature below 800° F. The normally liquid portion of the hydrocracker effluent product has a surprisingly low sulfur content of less than 0.1 weight percent, a low nitrogen content of less than 0.5 weight percent, and a high API gravity of at least −3.

24 Claims, 1 Drawing Figure

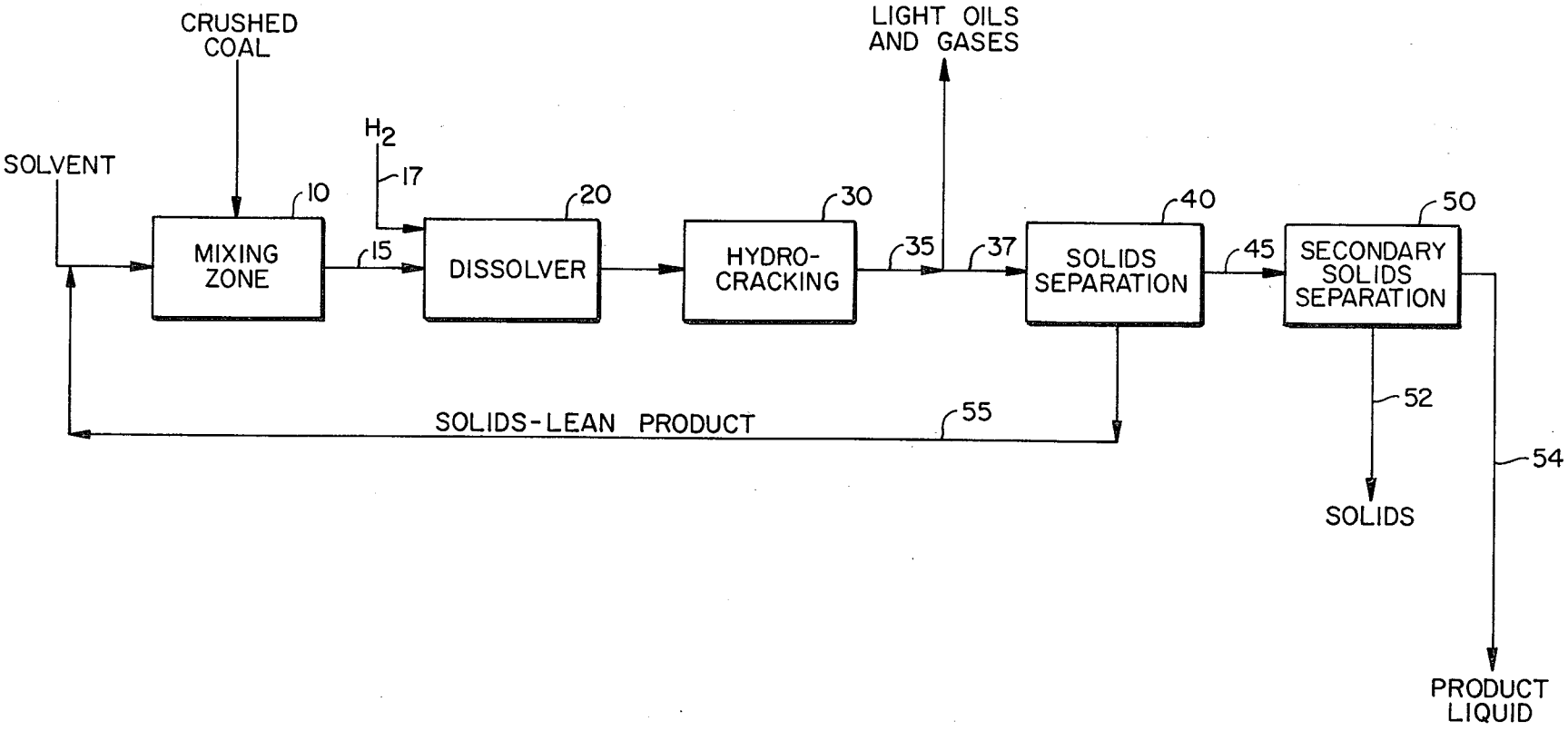
CRUSHED COAL
SOLVENT
MIXING ZONE
10
15
$H_2$
17
DISSOLVER
20
HYDRO-CRACKING
30
35
LIGHT OILS AND GASES
37
SOLIDS SEPARATION
40
45
SECONDARY SOLIDS SEPARATION
50
52
SOLIDS
54
PRODUCT LIQUID
55
SOLIDS-LEAN PRODUCT

COAL LIQUEFACTION PROCESS

CROSS-REFERENCE TO RELATED APPLICATION

This application is a continuation-in-part of application Ser. No. 754,198, filed Dec. 27, 1976, now U.S. Pat. No. 4,330,389 disclosure of which is incorporated herein by reference.

BACKGROUND OF THE INVENTION

The present invention relates to the liquefaction of coal to produce a normally liquid product which is low in sulfur and nitrogen and has a particularly high API gravity.

As a consequence of the increasing costs and diminishing supplies of petroleum much research is being conducted into better ways of obtaining synthetic fuels from solids such as coal. Furthermore, as a consequence of increased emphasis on the reduction of air pollution, fuels with low sulfur and low nitrogen contents are in great demand. Unfortunately, however, most coals contain large amounts of sulfur and nitrogen which end up in the synthetic liquids produced from the coal which necessitates additional costly sulfur and nitrogen removal steps, further increasing the costs of the synthetic fuels.

Numerous processes are well known in the art for the production of liquid products from coal.

In many processes for coal liquefaction, hydrogen is supplied by a liquid donor solvent. In such processes, the function of any catalyst is to rehydrogenate the solvent by adding molecular hydrogen to it. Thus the solvent acts as a medium to carry hydrogen from the catalyst to the solid coal. However, in such processes the catalyst is typically rapidly deactivated with the result that the process is highly inefficient and not conducive to a commercial coal hydrogenation process.

Another problem with prior art processes results from the insoluble solids which are contained in the liquid product. Typically, the liquid product from a coal liquefaction process has a high molecular weight. The high molecular weight of the product makes it very difficult to separate the very fine insoluble solids (coal residue). Furthermore, it has generally been taught that these insoluble solids must be separated prior to further processing in order to prevent downstream catalyst deactivation.

A further problem of prior art coal liquefaction processes is that the normally liquid product typically contains 0.2 to 1.0 or more weight percent sulfur and nitrogen. These potential pollutants must be removed in order to produce a valuable clean fuel and the removal of these contaminants requires costly additional hydroprocessing steps which further increase the cost of the product.

Typical of the prior art processes is the Gulf catalytic coal liquefaction process, disclosed in *Coal Conversion Technology,* Smith et al., Noyes Data Corporation (1976), where a slurry of coal and a process-derived solvent is forced up through a bed of catalyst at 900° F. and 2000 psig. The product, as taught in Sun W. Chun, National Science Foundation, Ohio State University Workshop, "Materials Problems and Research", Apr. 16, 1974, has a gravity of 1.2° API, a sulfur content of 0.11 weight percent, and a nitrogen content of 0.63 weight percent.

Another typical and well-known prior art process is the Synthoil process wherein a coal solvent slurry is pumped into a catalytic fixed bed reactor with hydrogen at a high velocity. Similar to the Gulf process, the Synthoil process also produces a liquid product, as taught in "Coal Liquefaction", Sam Friedman et al., presented at NPRA National Fuels & Lubricants Meeting, Nov. 6–8, 1974, Houston Tex., which has a gravity of −0.72° API and a sulfur content of 0.2 weight percent.

SUMMARY OF THE INVENTION

A process for liquefying coal, which comprises:

(a) forming a coal-solvent slurry by mixing subdivided coal with a solvent;

(b) substantially dissolving said coal in said solvent by heating said slurry to a temperature between 750° and 950° F. thereby forming a mixture comprising solvent, dissolved coal, and insoluble solids;

(c) contacting said mixture in a reaction zone with hydrogen and a hydrocracking catalyst under hydrocracking conditions including a temperature below 800° F.; and (d) withdrawing from said reaction zone an effluent stream, the normally liquid portion of which has an API gravity greater than −3.

Furthermore, the normally liquid portion of the product has an extremely low sulfur content of less than 0.10 weight percent and a nitrogen content less than 0.50 weight percent.

BRIEF DESCRIPTION OF THE DRAWING

The drawing is a schematic flow diagram of one preferred embodiment of the invention.

DETAILED DESCRIPTION OF THE INVENTION AND PREFERRED EMBODIMENTS

One object of the present invention is to provide an improved process for the liquefaction of coal whereby a normally liquid product is obtained having an API gravity of at least −3, a low sulfur content of less than 0.10 weight percent, and a low nitrogen content of less than 0.50 weight percent.

Another object of the present invention is to produce a solids-free, normally liquid product which is particularly useful as a turbine fuel.

Still another object of the present invention is to produce a liquid product from which insoluble coal solids (coal ash) can be more easily and economically removed, for example, by gravity settling.

It is an essential feature and critical to obtaining the above objects that the process of the present invention be carried out in at least two separate and distinct stages under critical process conditions. It is essential that the coal is substantially dissolved in a high temperature first stage in the range 750° to 900° F. to produce a mixture of dissolved coal, solvent and insoluble solids followed by contacting the mixture with a hydrocracking catalyst in a second stage under hydrocracking conditions including a critical temperature below 800° F. and preferably in the range of 600° to 799° F. Preferably the temperature in the hydrocracking stage will always be below the temperature in the dissolving zone, preferably 100° to 150° F. lower.

Another aspect of this invention is the use of an upflow reactor containing a fixed bed of particulate catalyst under any appropriate hydrocracking conditions to process coal liquefaction process streams containing coal-derived solids, such as the effuent from the first stage dissolution zone of the above two-stage process, or other such solids-containing streams.

In order to further describe the invention, reference is made to the figure which represents one preferred embodiment of the invention.

Subdivided coal, together with a hydrogen donor solvent, is fed into a mixing zone 10. The basic feedstock of the present invention is a solid subdivided coal such as anthracite, bituminous coal, subbituminous coal, lignite and mixtures thereof. Particularly preferred are the bituminous and subbituminous coals. Generally, it is desired to grind the coal to a particle size distribution from about 100 mesh and finer. However, larger sizes can be utilized.

The solvent materials are well known in the art and comprise aromatic hydrocarbons which are partially hydrogenated, generally having one or more rings at least partially saturated. Several examples of such materials are tetrahydronaphthalene, dihydronaphthalene, dihydroalkylnaphthalenes, dihydrophenanthrene, dihydroanthracene, dihydrochrysenes and the like. It will be understood that these materials may be obtained from any source, but are most readily available from the product of the present invention. It is most preferred to use a solvent obtained from the process, more particularly, a portion of the 400° F. and higher boiling fraction obtained from fractionation of the hydrocracking zone effluent as described later herein.

The subdivided coal is mixed with a solvent in a solvent-coal weight ratio from about 1:2 to 3:1, preferably from about 1:1 to 2:1. From mixing zone 10 the slurry is fed through line 15 to the dissolving zone 20. In dissolving zone 20, the slurry is heated to a temperature in the range of 750° to 900° F., preferably 800° to 850° F., and more preferably 820° to 840° F., for a length of time sufficient to substantially dissolve the coal. At least 50 weight percent and more preferably greater than 70 percent, and still more preferably greater than 90 percent of the coal, on a moisture and ash-free basis, is dissolved in zone 20, thereby forming a mixture of solvent, dissolved coal and insoluble solids. It is essential that the slurry be heated to at least 750° F. to obtain at least 50 percent dissolution of the coal. Further, it is essential that the coal not be heated to higher temperatures above 900° F. since this results in thermal cracking which substantially reduces the yield of normally liquid products.

Preferably, hydrogen is also introduced into the dissolving zone through line 17 and comprises fresh hydrogen and recycle gas. Except for the temperature, reaction conditions in the dissolving zone can vary widely in order to obtain the minimum of at least 50 percent dissolution of solids. Other reaction conditions in the dissolving zone include a residence time of 0.01 to 3 hours, preferably 0.1 to 1.0 hour, a pressure in the range 0 to 10,000 psig, preferably 1500 to 5000 psig, and more preferably 1500 to 2500 psig, a hydrogen gas rate of 0 to 20,000 standard cubic feet per barrel of slurry, and preferably 3000 to 10,000 standard cubic feet per barrel of slurry. If hydrogen is added to the dissolving zone, then it is preferred to maintain the pressure in the dissolving zone above 500 psig. The slurry may flow upwardly or downwardly in the dissolving zone. Preferably the zone is elongated sufficiently such that plug flow conditions are approached which allow one to operate the process of the present invention on a continuous basis rather than on a batch operation basis.

The dissolving zone contains no catalyst from any external source although the mineral matter contained in the coal may have some catalytic effect. Preferably the dissolving zone contains no contact particles from any external source.

The mixture of dissolved coal, solvent and insoluble solids is fed into a second stage reaction zone 30 containing a hydrocracking catalyst. In the hydrocracking zone, hydrogenation and cracking occur simultaneously, and the higher-molecular-weight compounds are converted to lower-molecular-weight compounds, the sulfur in the sulfur-containing compounds is converted to hydrogen sulfide, the nitrogen in the nitrogen-containing compounds is converted to ammonia, and the oxygen in the oxygen-containing compounds is converted to water. Preferably, the catalytic reaction zone is a fixed-bed type, but an ebullating bed can also be utilized. The mixture of gas, liquids and insoluble solids preferably passes upwardly through the catalytic reaction zone, but may also pass downwardly.

The primary advantage of passing such a mixture of gas, liquids and insoluble solids upwardly through the fixed bed of particulate catalyst is that the probability for plugging is reduced. Downflow operation can cause particles in the reactor feed to bridge interstices between stationary catalyst particles. Upflow operation, on the other hand, results in opposing forces on the particles; the gravitational forces and the forces exerted by the flowing fluid. These opposing forces tend to reduce the probability of bridging. In addition, the gravitational force tends to dislodge localized plugs which may form.

A particularly desirable method of operating the process is for the fixed catalytic bed to be operated in an upflow mode, with the lower portion of the catalyst in the bed being removed as the catalyst becomes fouled. Fresh catalyst can be added to the top of the fixed bed to replace the catalyst which is removed from the bottom. This addition and removal of catalyst can take place periodically or in a continuous or semi-continuous manner. Continuous catalyst replacement according to this invention is carried out at such a low rate that the catalyst bed is properly described as a fixed bed.

The catalysts used in the second stage of the process may be any of the well-known and commercially available hydrocracking catalysts. A suitable catalyst for use in the hydrocracking reaction stage comprises a hydrogenation component and a cracking component. Preferably, the hydrogenation component is supported on a refractory cracking base. Suitable cracking bases include, for example, weakly acidic cracking bases such as alumina or two or more refractory oxides such as silica, or alumina, silica-alumina, silica-magnesia, silica-zirconia, alumina-boria, silica-titania, silica-zirconia-titania, acid-treated clays and the like. Acidic metal phosphates such as alumina phosphate may also be used. Preferred cracking bases comprise composites of silica and alumina, and alumina alone is particularly preferred. Suitable hydrogenation components are selected from Group VI-B metals, Group VIII metals, their oxides or mixtures thereof. Particularly useful are cobalt-molybdenum, nickel-molybdenum, or nickel-tungsten on silica-alumina supports.

It is critical to the process of the present invention that the temperature in the hydrocracking zone is not too high because it has been found that the catalyst is rapidly fouled at high temperatures. The temperature in the hydrocracking zone must be maintained below 800° F., preferably in the range 650° to 799° F., and more preferably 650° to 750° F. Generally the temperature in the hydrocracking zone will always be below the temperature in the dissolving zone and preferably 100° to 150° F. lower. Other hydrocracking conditions include a pressure from 500 to 5000 psig, preferably 1000 to 3000 psig, and more preferably 1500 to 2500 psig, hydrogen rate of 2000 to 20,000 standard cubic feet per barrel of slurry, preferably 3000 to 10,000 standard cubic feet per barrel of slurry and a slurry hourly space velocity in the range 0.1 to 2, preferably 0.2 to 0.5.

Preferably, the pressure in the noncatalytic dissolving stage and the catalytic hydrocracking stage are essentially the same.

Preferably the entire effluent from the dissolving zone is passed to the hydrocracking zone. However, since small amounts of water and light gases ($C_1$ to $C_4$) are produced in the first stage, the catalyst in the second stage is subject to a lower hydrogen partial pressure than if these materials were absent. Since higher hydrogen partial pressures tend to increase catalyst life, it may be preferable in a commercial operation to remove a portion of the water and light gases before the stream enters the hydrocracking stage.

The product effluent 35 from reaction zone 30 is separated into a gaseous fraction 36 and a solids-liquid fraction 37. The gaseous fraction comprises light oils boiling below about 300° to 500° F., preferably below 400° F., and normally gaseous components such as $H_2$, CO, $CO_2$, $H_2S$ and the $C_1$ to $C_4$ hydrocarbons. Preferably the $H_2$ is separated from the other gaseous components and recycled. Liquids-solid fraction 37 is fed to solids separation zone 40 wherein the stream is separated into a solids-lean stream 55 and solids-rich stream 45. The insoluble solids are separated by conventional means, for example, hydrocyclones, filtration, centrifugation and gravity settling or any combination of these. Preferably, the insoluble solids are separated by gravity settling which is a particularly added advantage of the present invention since the effluent from the hydrocracking reaction zone has a particularly low viscosity and a high API gravity of at least −3. The high API gravity of the effluent allows rapid separation of the solids by gravity settling such that 50 weight percent and generally 90 weight percent of the solids can be rapidly separated in a gravity settler. Preferably, the insoluble solids are removed by gravity settling at an elevated temperature in the range 200° to 800° F., preferably 300° to 400° F., and at a pressure in the range 0 to 5000 psig, preferably 0 to 1000 psig. Separation of the solids at an elevated temperature and pressure is particularly desirable. The solids-lean product stream is removed via line 55 and recycled to the mixing zone, while the solids-rich stream is passed to secondary solids separation zone 50 via line 45. Zone 50 may include distillation, fluid coking, delayed coking, centrifugation, hydrocloning, filtration, settling, or any combination of the above. The separated solids are removed from zone 50 via line 52 and disposed of or utilized for their fuel value, while the product liquid is removed via line 54. The liquid product is essentially solids-free, containing less than 1.0 weight percent solids.

The process of the present invention produces extremely clean normally liquid products. The normally liquid products, that is, all of the product fractions boiling above $C_4$, have an unusually high API gravity of at least −3, preferably above 0 and more preferably above 5; a low sulfur content of less than 0.1 weight percent, preferably less than 0.02; and a low nitrogen content less than 0.5 weight percent, preferably less than 0.2 weight percent.

As is readily apparent from the drawing, the process of the present invention is extremely simple and produces clean, normally liquid products from coal which are useful for many purposes. The broad-range product is particularly useful as a turbine fuel, while particular fractions are useful for gasoline, diesel, jet, and other fuels.

The advantages of the present invention will be readily apparent from a consideration of the following examples.

EXAMPLE 1

A slurry consisting of 33 weight percent Illinois #6 coal and 67 weight percent recycle oil was passed sequentially through a first-stage dissolving zone and a second-stage hydrocracking zone. The coal was 100-minus mesh coal and had the following analysis on a weight-percent dry basis: C—64, H—4.5, N—1.0, O—12.5, S—4.0, ash—14.0. The solvent (recycle oil) was a 400° F.+ fraction obtained from a previous run. Hydrogen was introduced into the first stage at a rate equal to 10,000 SCF/bbl of slurry. The slurry had a residence time of 1.4 hours in the first stage, which was maintained at 2400 psig and 835° F. The mixture of gases, liquids, and solids was then passed entirely to the second stage, which contained a fixed bed containing primarily a hydrocracking catalyst consisting of 6.6 weight percent nickel and 19.2 weight percent tungsten with an alumina base containing 30 ppm Ti. The second stage was maintained at 2400 psig and 670° F. and the space velocity based on the feed slurry was 0.25. The effluent was separated into recycle liquid (400° F.+) and coal-derived product. The yields are shown below, after 1300 hours of operation.

| Product | Wt. % of Dry Coal |
|---|---|
| $C_1$–$C_3$ | 8.2 |
| $C_4$–400 | 2.5 |
| 400–700 | 39.7 |
| 700–875 | 10.2 |
| 875+ oil | 11.1 |
| Unreacted coal | 6.0 |
| Ash | 13.5 |
| $NH_3$, $H_2S$, $H_2O$ | 13.9 |

The normally liquid product, that is, the $C_4$ through 875° F. fractions, had the following properties: °API, 8; nitrogen, 0.2 weight percent; oxygen, 0.69 weight percent; and sulfur, 0.03 weight percent.

EXAMPLE 2

A slurry consisting of 25 weight percent 100-minus mesh Illinois #6 coal and 75 weight percent coal-derived oil (400° F.+) was passed sequentially through a first-stage dissolving zone and a second-stage hydrocracking zone as in Example 1. First-stage operating conditions included a temperature of 835° F. and 2400 psig. Hydrogen was introduced into the first stage at a rate equal to 10,000 SCF/bbl of slurry. The slurry had a residence time of 0.67 hours in the first stage. The entire mixture of gases, liquids and solids was then passed entirely to the second stage, which contained a hydrocracking catalyst. The second stage was maintained at 2400 psig and initially at 825° F. After 67 hours, the product quality had dropped from 9.5° API to 1° API. The temperature was then raised to 835° F. and the product gravity rose to 3.5° API, but dropped to 0° API after another 65 hours. At 835° F., the catalyst had reached the end of its useful activity and coking begin to hinder further operation.

Comparison of Examples 1 and 2 illustrates the criticality of maintaining a low temperature in the hydrocracking stage of the process of the present invention.

EXAMPLE 3

Cold flow modeling tests were performed to compare the performance of a fixed bed reactor in upflow and downflow service. The tests were performed by passing an aqueous suspension of solids, together with nitrogen through a 9.5-inch diameter containing a fixed bed of 1/10 inch diameter particulate cylindrical extrudate catalyst. In the upflow experiment the aqueous suspension contained about 7% coal liquefaction fines with a mean diameter of about 8 micrometer. The fines were obtained from a two-stage coal liquefaction process, washed in ethyl acetate and dried. In the downflow experiment the aqueous suspension contained about 10% fresh oil shale fines with a mean diameter of about 13 micrometers. In each test the slurry hourly space velocity was 0.25 $hours^{-1}$ and the nitrogen rate was 10,000 standard cubic feet per barrel. The downflow reactor experienced a pressure drop of about 0.1 psi per foot of reactor for the first 70 minutes of operation on slurry feed. Within the next 15 minutes of operation, the pressure drop increased to about 2.6 psi per foot of reactor. The upflow reactor experienced a pressure drop of generally 0.5–0.7 psi per foot of reactor for 780 minutes of operation on slurry feed, after which the run was voluntarily terminated.

What is claimed is:

1. A process for liquefying coal, which comprises:

(a) forming a coal-solvent slurry by mixing subdivided coal with a solvent;

(b) substantially dissolving said coal in said solvent by heating said slurry in a dissolving zone in the presence of added hydrogen, thereby forming a mixture comprising solvent, dissolved coal, and insoluble solids;

(c) contacting at least a portion of said mixture containing insoluble solids with hydrogen in a reaction zone by passing said portion with hydrogen upwardly through a fixed bed of hydrocracking catalyst at a slurry hourly space velocity of 0.1–2, and a temperature below 800° F. and below the temperature to which the slurry was heated in said dissolving zone, and (d) withdrawing an effluent stream from said reaction zone.

2. A process according to claim 1 wherein the entire effluent from said dissolving zone is passed through said fixed bed of hydrocracking catalyst in said reaction zone.

3. A process according to claim 1 wherein said hydrocracking catalyst comprises one or more elements selected from Group VIB and Group VIII supported on a particulate support.

4. A process according to claim 3 wherein said particulate support consists essentially of alumina.

5. A process according to claim 1 wherein said dissolving zone is free of externally supplied catalyst.

6. A process according to claim 1 wherein said dissolving zone is free of externally supplied catalyst or contact particles.

7. A process according to claim 1 wherein said coal is bituminous coal.

8. A process according to claim 1 wherein said contacting step is conducted at a pressure in the range of 1000 to 3000 psig.

9. A process according to claim 1 wherein said effluent from said reaction zone has a normally liquid portion characterized by an API gravity greater than 5, a sulfur content less than 0.1 weight percent, and a nitrogen content less than 0.5 weight percent.

10. A process according to claim 1 wherein greater than 90 percent of said coal on a moisture and ash-free basis is dissolved in said dissolving zone.

11. A process according to claim 1 wherein said reaction zone is operated with a hydrogen rate of 3000 to 10,000 standard cubic feet per barrel of slurry.

12. A process according to claim 1 wherein said coal-solvent slurry is heated at a temperature between 750° and 900° F. in said dissolving zone to dissolve greater than 90 percent of said coal on a moisture and ash-free basis, and wherein said reaction zone is operated at a pressure in the range of 1000 to 3000 psig.

13. A process according to claim 12 wherein the entire effluent from said dissolving zone is passed through said fixed bed of hydrocracking catalyst in said reaction zone.

14. A process according to claim 12 wherein said hydrocracking catalyst comprises one or more elements selected from Group VIB and Group VIII supported on a particulate support.

15. A process according to claim 14 wherein said support consists essentially of alumina.

16. A process according to claim 12 wherein said dissolving zone is free of externally supplied catalyst.

17. A process according to claim 12 wherein said dissolving zone is free of externally supplied catalyst or contact particles.

18. A process according to claim 12 wherein said effluent from said reaction zone has a normally liquid portion characterized by an API gravity greater than 5, a sulfur content less than 0.1 weight percent, and a nitrogen contact less than 0.5 weight percent.

19. A process according to claim 12 wherein said reaction zone is operated with a hydrogen rate of 3000 to 10,000 standard cubic feet per barrel of slurry.

20. A process according to claim 1, 6, 8 or 9 wherein said portion of said mixture is passed from said dissolving zone to said reaction zone without an intervening solids separation step.

21. A process according to claim 12, 17, 18 or 19 wherein said portion of said mixture is passed from said dissolving zone to said reaction zone without an intervening solids separation step.

22. A process according to claim 8 wherein said dissolving zone is free of externally supplied catalyst or contact particles and said portion of said mixture is passed from said dissolving zone to said reaction zone without an intervening solids separation step.

23. A process for liquefying coal which comprises (a) forming a coal-solvent slurry by mixing subdivided coal with a solvent;

(b) dissolving at least about 90% of said coal, on a moisture and ash-free basis, in said solvent by heating said slurry in a dissolving zone in the presence of added hydrogen and in the absence of externally supplied catalyst or contact particles to a temperature between 750° and 900° F., thereby forming a mixture comprising solvent, dissolved coal and insoluble solids;

(c) passing the entire mixture comprising solvent, dissolved coal and insoluble solids, with hydrogen, upwardly through a fixed bed of hydrocracking catalyst at a slurry hourly space velocity of 0.1–2, a temperature below 800° F., a pressure in the range of 1000–3000 psig, and a hydrogen rate of 3000 to 10,000 standard cubic feet per barrel of slurry; and (d) withdrawing an effluent from said reaction zone, said effluent having a normally liquid portion characterized by an API gravity greater than 5, a sulfur content less than 0.1 weight percent and a nitrogen content less than 0.5 weight percent.

24. A process according to claim 23 wherein said hydrocracking catalyst comprises one or more elements selected from Group VIB and Group VIII supported on a particulate support consisting essentially of alumina.

* * * * *

UNITED STATES PATENT AND TRADEMARK OFFICE

CERTIFICATE OF CORRECTION

PATENT NO. : 4,354,920

DATED : October 19, 1982

INVENTOR(S) : Joel W. Rosenthal et al.

It is certified that error appears in the above-identified patent and that said Letters Patent is hereby corrected as shown below:

The term of this patent subsequent to May 18, 1999 has been disclaimed.

Signed and Sealed this

*Fourth* Day of *January 1983*

[SEAL]

*Attest:*

GERALD J. MOSSINGHOFF

*Attesting Officer*

*Commissioner of Patents and Trademarks*